US005203125A

United States Patent [19]

Sugizaki

[11] Patent Number: 5,203,125

[45] Date of Patent: Apr. 20, 1993

[54] OPENABLE ROOF

[75] Inventor: Kenichi Sugizaki, Tokyo, Japan

[73] Assignee: Shimizu Construction Co., Ltd., Tokyo, Japan

[21] Appl. No.: 865,700

[22] Filed: Apr. 8, 1992

Related U.S. Application Data

[63] Continuation of Ser. No. 567,134, Aug. 14, 1990, abandoned.

[30] Foreign Application Priority Data

Aug. 16, 1989 [JP] Japan ..... 1-211175

[51] Int. Cl.[5] ..... E04B 1/346

[52] U.S. Cl. ..... 52/66

[58] Field of Search ..... 52/65, 66

[56] References Cited

U.S. PATENT DOCUMENTS

| | | | |
|---|---|---|---|
| 4,174,594 | 11/1979 | Panzini | 52/65 |
| 4,587,775 | 5/1986 | Lewis et al. . | |
| 4,676,033 | 6/1987 | Allen et al. . | |
| 4,738,057 | 4/1988 | Logan . | |
| 4,783,861 | 11/1988 | Leurent . | |
| 4,942,698 | 7/1990 | Kumagai | 52/66 X |
| 5,007,214 | 4/1991 | Itami et al. | 52/66 |

FOREIGN PATENT DOCUMENTS

| | | |
|---|---|---|
| 57-108355 | 7/1982 | Japan . |
| 61-162648 | 7/1986 | Japan . |
| 63-181829 | 7/1988 | Japan . |
| 61183910 | 8/1990 | Japan . |
| 354206 | 8/1931 | United Kingdom . |
| 2179975 | 3/1987 | United Kingdom . |
| 2188957 | 10/1987 | United Kingdom . |
| 2199859 | 7/1988 | United Kingdom . |
| 8606123 | 6/1989 | World Int. Prop. O. . |

OTHER PUBLICATIONS

The SkyDome retractable roof system, Engineering Digest.

*Primary Examiner*—David A. Scherbel
*Assistant Examiner*—Creighton Smith
*Attorney, Agent, or Firm*—Scully, Scott, Murphy & Presser

[57] ABSTRACT

An openable roof includes a plurality of movable roof members. Each of the movable roof members is of a generally sectorial shape in two-dimensional projection. The sectorial shape has a radially outer edge portion and a radially inner edge portion. The outer edge portion of the movable roof member is movably disposed on an outer arcuate support. The inner edge portion of the movable roof member is movably disposed on an inner arcuate support. The outer and inner arcuate supports are disposed concentrically about a common axis. Accordingly, each of the movable roof members is able to revolve around the axis of the arcuate supports so as to participate to open and close a sectorial opening portion provided between the arcuate supports.

13 Claims, 8 Drawing Sheets

OPENABLE ROOF

This is a continuation of copending application Ser. No. 567,134 filed on Aug. 14, 1990 now abandoned.

BACKGROUND OF THE INVENTION

The present invention relates to an openable roof comprising a plurality of slidable (movable) roof members which are of partially sectorial shape when viewed from above, and which are arcuately movable along a prescribed arcuate path about a central axis of rotation.

In compliance with the duty of disclosure, the present applicant discloses four U.S. patent applications, Ser. Nos. 07/439,302, 07/502,170, 07/502,613, and 07/523,720.

Openable roofs are highly desirable as they provide sunlight, fresh air, and a sense of freedom when open, while protecting the interior from adverse weather when closed. To this end, various types of openable roofs were previously proposed and developed.

However, most of the openable roofs involve the following problems:

The configurations of the movable roof members and the travelling mechanisms for travelling the members are complicated. In openable roofs, the portion of the opening is necessarily narrow, and the support for supporting the movable roof members must withstand a highly concentrated load from the movable roof members.

SUMMARY OF THE INVENTION

It is therefore an object of the present invention to provide an openable roof wherein the configurations of the movable roof members, and the travelling mechanisms for travelling the members, are simplified.

Another object of the invention is to provide an openable roof wherein the portion of the opening is relatively broad.

A further object of the invention is to provide an openable roof wherein the load from the movable roof members is effectively distributed.

In order to achieve the above objects, the openable roof in one aspect of the invention includes a plurality of movable roof members. Each of the movable roof members is of a generally sectorial shape in two-dimensional projection. The sectorial shape has a radial outer edge portion and a radial inner edge portion. The outer edge portion of the movable roof member is movably disposed on an outer arcuate support. The inner edge portion of the movable roof member is movably disposed on an inner arcuate support. The outer and inner arcuate supports are disposed concentrically about a common axis. Accordingly, each of the movable roof members is able to revolve around the axis of the arcuate supports so as to participate in the opening and closing of a sectorial opening portion provided between the arcuate supports.

With the above construction, the configuration of the movable roof members, and the travelling mechanisms for travelling the members, can be simplified and made compact. Accordingly, the cost of constructing the roof members and the travelling mechanisms is decreased.

Additionally, since the movable roof members are disposed on the arcuate tracks, the load from the movable roof members is effectively distributed on the tracks. Consequently, the stability of the whole roof structure can be improved.

Furthermore, by virtue of the inner arcuate support, there is provided a sectorial space defined by the inner support. Accordingly, the area wherein the structure is built can be relatively small. Thus, the cost of the land for the structure with the openable roof is reduced. Alternatively, the space saved can be utilized for other purposes.

Moreover, since the roof members are supported on the pair of arcuate supports, the length of the roof members, along the radial direction of the arcuate shape thereof, can be compact. Hence, the bending moment exerted on each of the roof members can be decreased. The roof members can be designed so that the mechanical strength thereof is relatively small and the weight thereof is also small. Accordingly, the cost of constructing the roof members and the travelling mechanisms is decreased.

More preferably, the openable roof further comprises at least one fixed roof member which is disposed at a side of the sectorial opening. Each fixed roof member is of a generally sectorial shape in two-dimensional projection. Each of the sectorial shapes has a radially outer edge portion and a radially inner edge portion. The outer edge portion of the fixed roof member is fixedly disposed on an outer arcuate support. The inner edge portion of the fixed roof member is fixedly disposed on an inner arcuate support so that the movable roof member is able to be stored under the fixed roof member when the roof is open.

In this case, since the movable roof members are stored under the fixed roof members when the roof is open, the portion of the opening is broader than that of conventional openable roofs. This heightens the sense of openness that people in the structure can feel.

More preferably, each of the fixed and the movable roof members comprises a section of a sphere, with a subsection removed, so that the entire openable roof is dome-shaped when the roof is closed.

More preferably, a pair of said fixed roof members are provided at both sides of the sectorial opening.

More preferably, a plurality of drive means are provided under the outer and inner edge portions of the movable roof members whereby the movable roof members are movably and drivingly supported on the arcuate supports via the drive means.

DETAILED DESCRIPTION OF THE PREFERRED EMBODIMENTS

Figure 1:
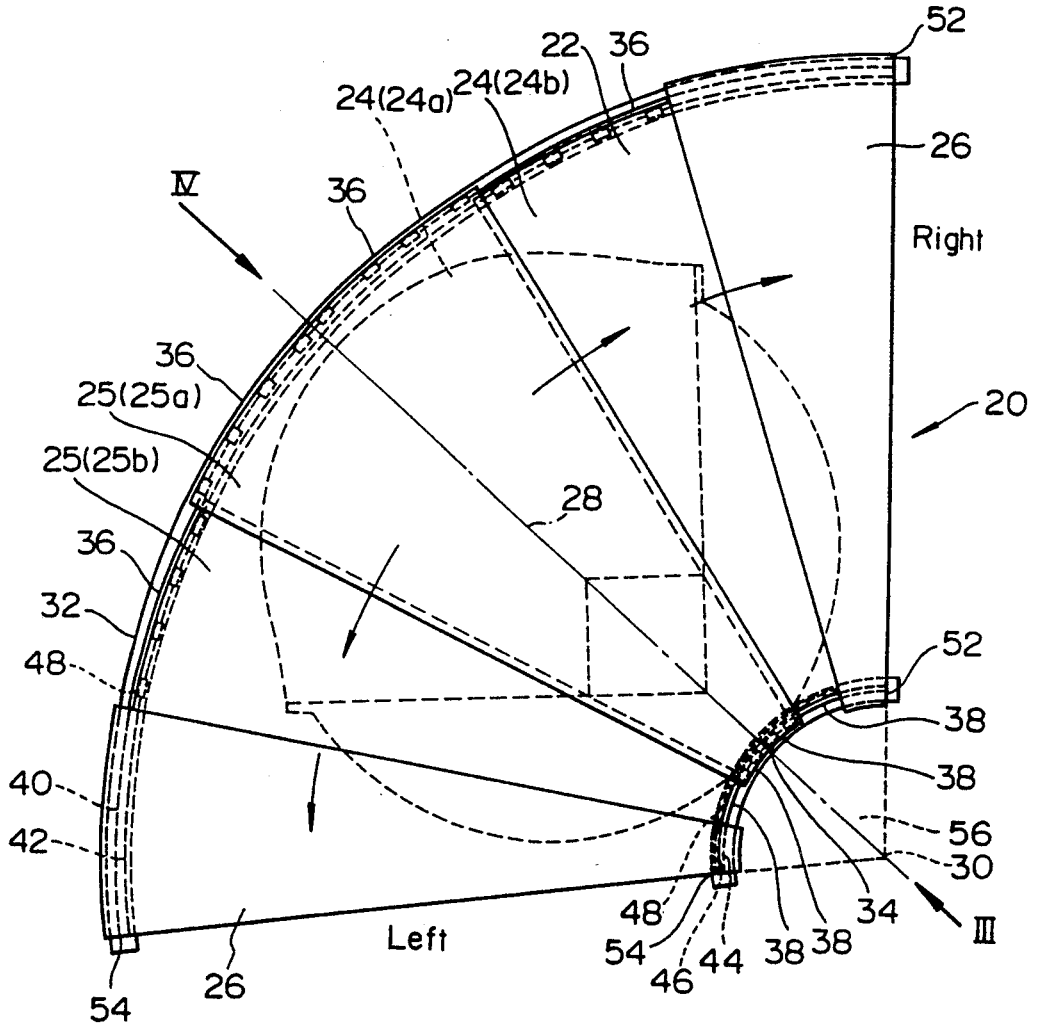
FIG. 1 is a plan view of an openable roof according to a first embodiment of the present invention, showing the roof in the closed configuration.

With reference to the accompanying drawings, various preferred embodiments of the present invention will be described in detail hereinafter.

First Embodiment

An openable roof 20 according to a first embodiment is represented in FIGS. 1 through 5. As shown in FIGS. 1 through 4, the openable roof 20 is disposed on a multipurpose stadium 22 in which baseball games may be played, concerts performed, and so on.

The openable roof 20 is generally of partially sectorial shape in plan view when the roof is closed. The openable roof 20 comprises four separate movable roof members (panels) 24 and 25 (24*a*, 24*b*, 25*a*, and 25*b*), and a pair of fixed roof members (panels) 26. Each of the movable and fixed roof members 24, 25, and 26 is also of a partially sectorial shape in plan view, so that the roof members 24, 25, and 26 cooperate to close off the stadium 22 from the outer environment. Also, each of the movable roof members 24*a*, 24*b*, 25*a*, 25*b* forms a central angel smaller than the central angle of the openable roof 20. Each of the movable and fixed roof members 24, 25, and 26 is of an arc shape in side view (FIGS. 3 and 4), so that the openable roof 20 is of a dome shape, that is, generally a portion of a sphere, when the roof 20 is closed.

Figure 2:
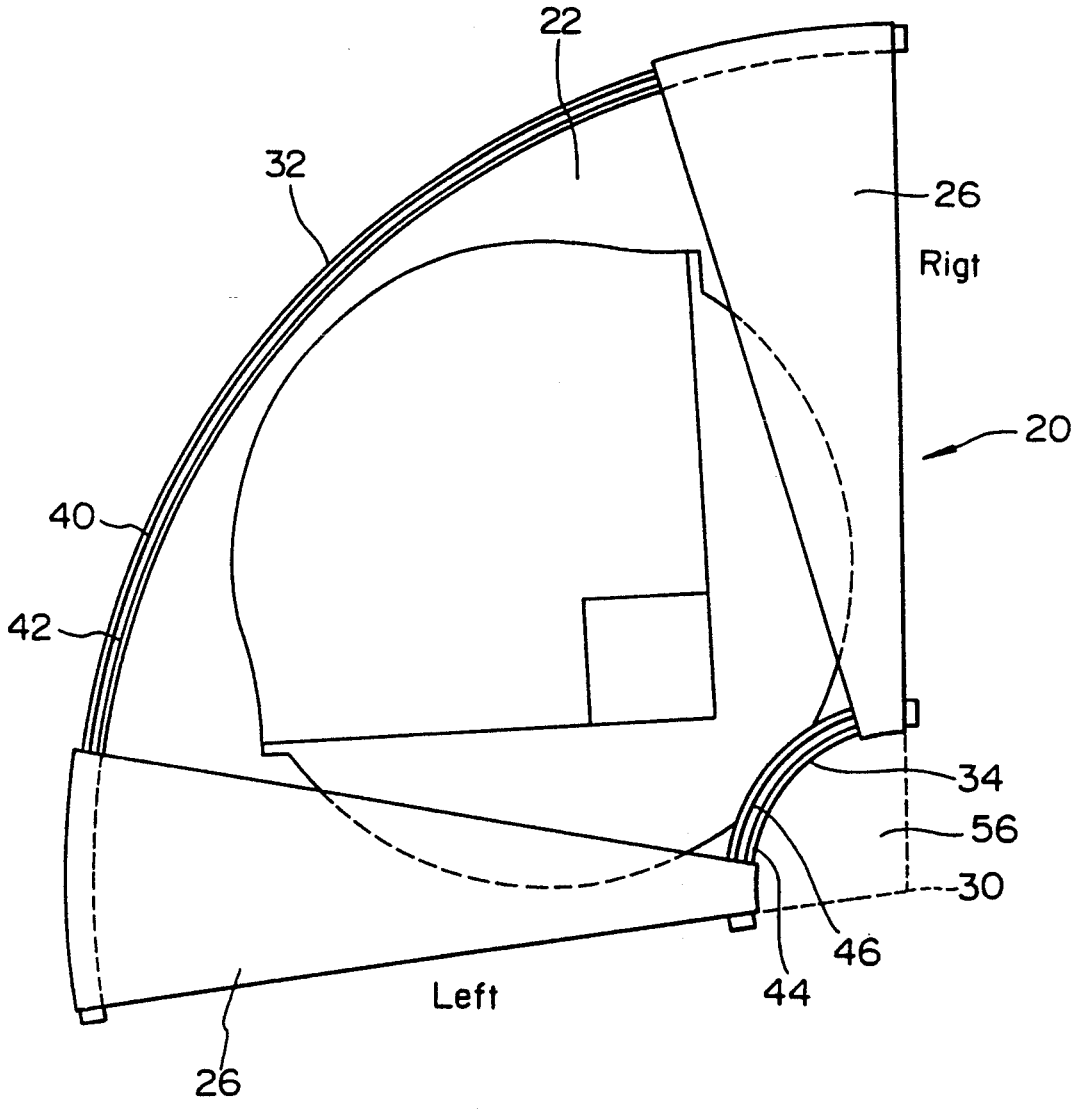
FIG. 2 is a plan view of the openable roof in FIG. 1, when the is in the open configuration.

As shown in FIGS. 1 and 2, the fixed roof members 26 are disposed on both of the sides (wings) of the roof 20. When the roof 20 is closed off, the movable roof members 24 and 25 intermediate between both the fixed roof members 26. For clarity, the movable roof members 24 and 25 are classified into a pair of right wing movable roof members 24 and a pair of left wing movable roof members 25.

In FIG. 1, the right wing movable roof members 24 and the left wing movable roof members 25 are symmetrically disposed about the center line 28 of the stadium 22. Each of the movable roof members 24 and 25 are slidably turned about the center axis 30 of the partially sectorial roof 20. Therefore, both of the right wing movable roof members 24 are lapped under the right wing fixed roof member 26 when the roof is closed off as shown in FIG. 2. Similarly, both the left wing movable roof members 25 are lapped under the left wing fixed roof member 26.

As shown in FIGS. 1 through 4, the movable and fixed roof members 24, 25, and 26 are supported on a pair of arcuate supports 32 and 34. The arcuate supports 32 and 34 are disposed in the same horizontal plane, and are disposed on the wall of the stadium 22. The radially outer arcuate support 32 and the inner arcuate support 34 are concentrically disposed in such a fashion that the above-mentioned center axis 30 is the common center of the supports 32 and 34.

The radially outer arcuate edges 36 of the movable roof members 24 and 25 are slidably disposed on the outer arcuate support 32. The radially inner arcuate edges 38 of the movable roof members 24 and 25 are also slidably disposed on the inner arcuate support 34. Accordingly, each movable roof members 24 and 25 can perform its own turning motions.

Figure 3:
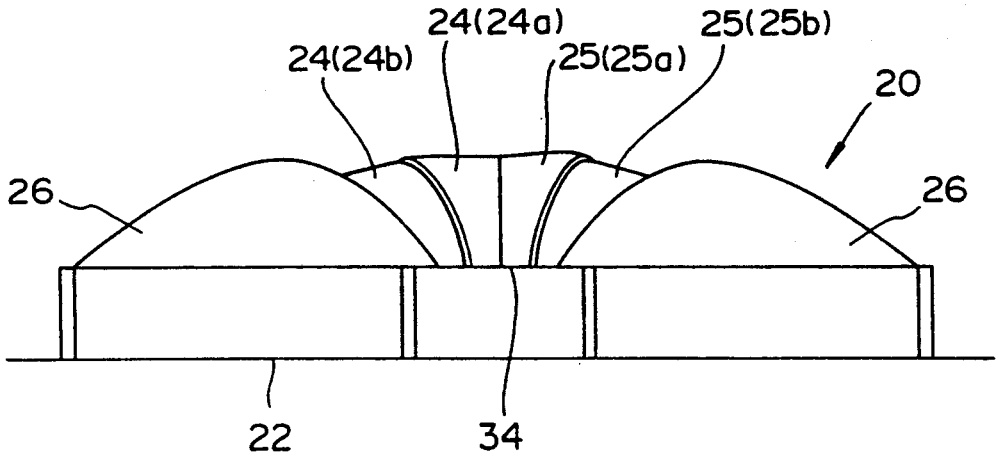
FIG. 3 is a side view of the openable roof in FIG. 1, showing a side indicated by arrow III in FIG. 1.
Figure 4:
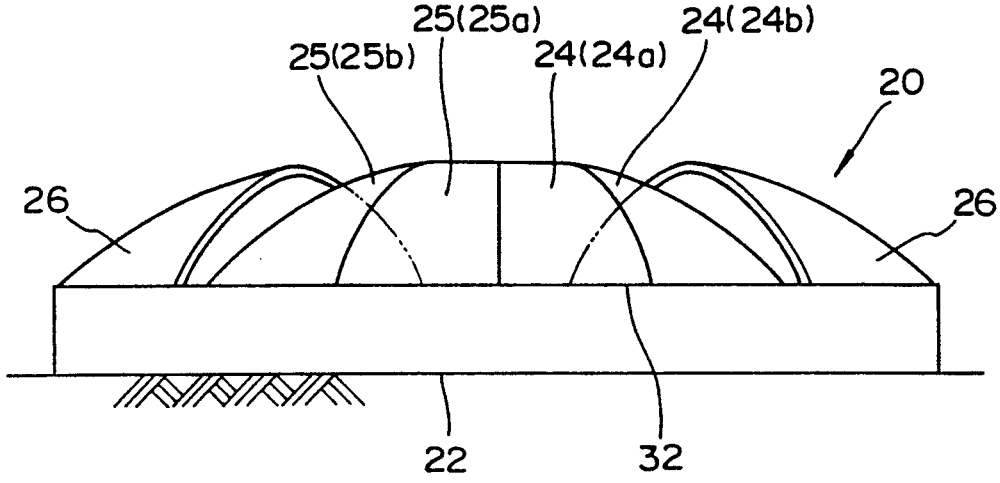
FIG. 4 is a side view of the openable roof in FIG. 1, showing a side indicated by arrow IV in FIG. 1.

As best shown in FIG. 3, the shape of each of the roof members 24, 25, and 26 is a portion of a sphere, the outer surface of which forms a generally continuous smooth curved surface when the roof is closed. However, the imaginary diameters of the roof members are slightly different from one another. That is, the imaginary diameter of the fixed roof members 26 is the greatest since the movable roof members 24 and 25 are stored under the fixed roof members 26 when the roof 20 is open.

In order to clarify this, the movable roof members 24 and 25 are classified into central movable roof members 24*a* and 25*a*, and side movable roof members 24*b* and 25*b*, hereinafter. The central movable roof members 24*a* and 25*a* may cover the central part of the stadium 22. The side movable roof members 24*b* and 25*b* may cover the sides of the stadium 22. The central right wing and the central left wing movable roof members 24 (24*a*) and 25 (25*a*) have the same imaginary diameter. The side right wing and left wing movable roof members 24 (24*b*) and 25 (25*b*) have the same imaginary diameter. The imaginary diameter of the central movable roof members 24*a* and 25*a* is greater than that of the side movable roof members 24*b* and 25*b*, so that the travelling paths of the central and side movable roof members 24*a* and 25*a* do not interfere with each other, and 24*b* and 25*b* do not interfere with each other. Consequently, the central movable roof members 24*a* and 25*a* are disposed over the side movable roof members 24*b* and 25*b* when the roof 20 is open.

A pair of rail-like tracks 40 and 42 are installed on the upper surface of the radially outer arcuate support 32, and continuously along the support 32. Similarly, a pair of rail-like tracks 44 and 46 are installed on the surface of the radially inner arcuate support 34, and continuously along the support 34. The tracks 40, 42, 44, and 46 are disposed in the same horizontal plane.

A plurality of electrically driven wheels 48, for example, servo-linear-motor-driven wheels, are connected to the lower surfaces of the arcuate edges 36 and 38 of the movable roof members 24 and 25, and drivingly disposed on the tracks 40, 42, 44, and 46 of the radially outer and inner arcuate supports 32 and 34.

Figure 5:
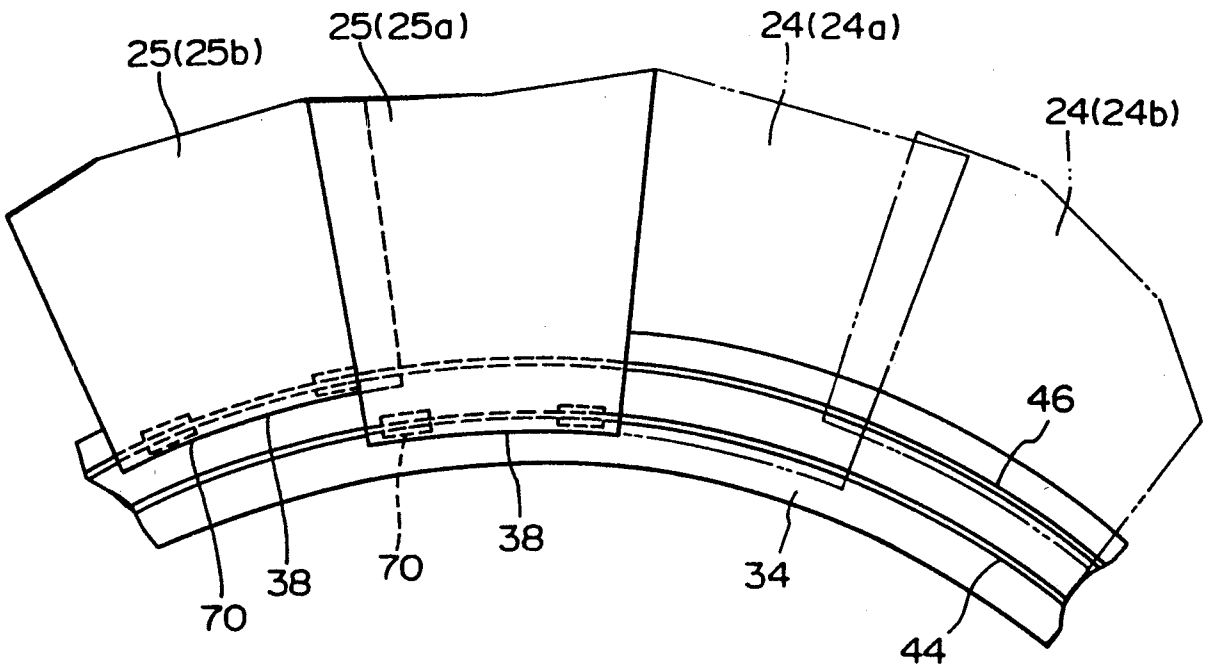
FIG. 5 is a plan view of the support tracks for supporting the movable roof members of the openable roof in FIG. 1, and on which the movable roof members travel.

As best shown in FIGS. 1 and 5, the central movable roof members 24*a* and 25*a* are slidably supported on the tracks 40 and 44. The side movable roof members 24*b* and 25*b* are also slidably supported on the tracks 42 and 46 in order to avoid interference between the central and side movable roof members. On the other hand, the fixed roof members 26 are fixedly secured on the supports 32 and 34.

Next, the operation and function of the above-described openable roof 10 will be explained hereinafter.

As shown in FIG. 1, when the roof 20 is closed, the central movable roof 24*a* and 25*a* are disposed above the center portion of the stadium 22, and the side movable roof 24*b* and 25*b* are disposed above the relatively sides of the stadium 22. The fixed roof members 26 are always disposed above the right and left wings. The roof members 24, 25, and 26 are slightly overlapped one over the other. Therefore, the interior area of the stadium 22 is closed off.

In order to open the roof 20, the right wing movable roof members 24 are respectively traveled along their own paths indicated by the arrow in FIG. 1, by means of the drive for the wheels 48. The rotational motion of the movable roof members 24 is stopped when the roof members 24 reach the right most wing 52 of the stadium 22. Accordingly, the right wing movable roof members 24 are disposed and stored under the right wing fixed roof member 26. Similarly, the left wing movable roof members 25 are disposed and stored under the left wing fixed roof member 26 at the left-most wing 54. Thus, an open area defined by both of the fixed roof members 26 is opened, exposing the interior, as shown in FIG. 2.

When closing off the movable roof, the reverse motions of the movable roof members 24 and 25 may be performed.

Since the widths as well as the horizontal angles of the movable roof members 24 and 25 are designed to be consistent in this embodiment, the central and side movable roof members 24*a*, 24*b*, 25*a* and 25*b* simultaneously reach the right-most or left-most wing if the central movable roof members 24*a* and 25*a* are driven at a angular velocity which is double that of the right or left-side movable roof members 24*b* and 25*b*.

If the angular velocities of all the roof members 24 and 25 are the same, first, the relative location of the central and the side roof members 24*a* and 24*b* (or 25*a* and 25*b*) are kept as in the closed position when travelling. However, the side movable roof members 24*b* and 25*b* reach the side-most wings 52 or 54, before the central movable roof members 24*a* and 25*a*. Then, the central movable roof members 24*a* and 25*a* travel alone until they reach the side-most wings 52 or 54.

With the above construction, the configuration of the movable roof members 24 and 25, and the travelling mechanisms (including the tracks 40, 42, 44, and 46 and the electrically driven wheels 48) for travelling the members, can be simplified and made compact. Accordingly, the costs of constructing the roof members and the travelling mechanisms is decreased.

In addition, since the movable roof members 24 and 25 are stored under the fixed roof members 26 when the roof 20 is open, the portion of the opening is broader than that of conventional openable roofs. This heightens the sense of openness and freedom experienced by the audience in the stadium 22.

Additionally, since the movable roof members 24 and 25 are disposed on the arcuate tracks 40, 42, 44, and 46, the load from the movable roof members 24 and 25 is effectively distributed on the tracks. Consequently, the stability of the whole roof structure 20 is improved.

Furthermore, by virtue of the inner arcuate support 34, there is provided a sectorial space 56 defined by the support 34 and the dotted lines in FIGS. 1 and 2. Accordingly, the area wherein the stadium 22 is built can be relatively small. Thus, the cost of the land on which the stadium 22 is built is reduced. Alternatively, the space 56 can be utilized for other purposes.

Moreover, since the roof members 24, 25, and 26 are supported on the pair of arcuate support 32 and 34, the length of the roof members 24, 25, and 26, along the radial direction of the arcuate shape thereof, can be compact. Hence, the bending moment exerted on each of the roof members 24, 25, and 26 can be decreased. The roof members can be designed so that the mechanical strength thereof is relatively small and the weight thereof is also small. Accordingly, the cost of constructing the roof members and the traveling mechanisms is decreased.

Although a first preferred embodiment of the present invention is described hereinbefore, the present invention is not intended to be limited to the first embodiment. Other embodiments in accordance with the spirit and objects of the invention will be described in the following.

Second Embodiment

Figure 6:
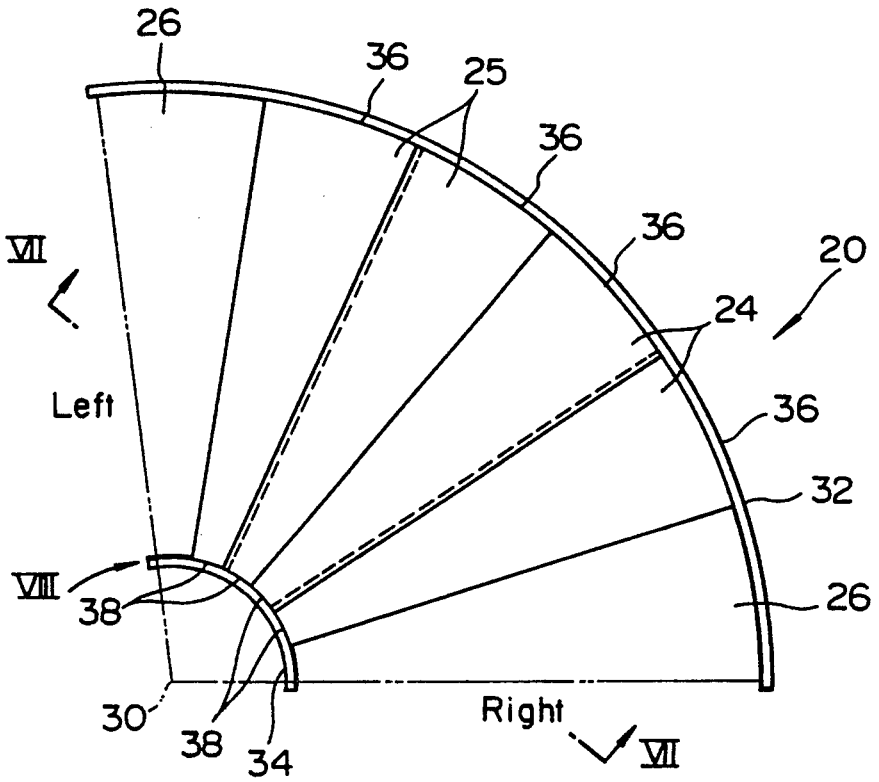
FIG. 6 is a simplified plan view of an openable roof according to a second embodiment of the present invention, showing the roof in the closed configuration.
Figure 7:
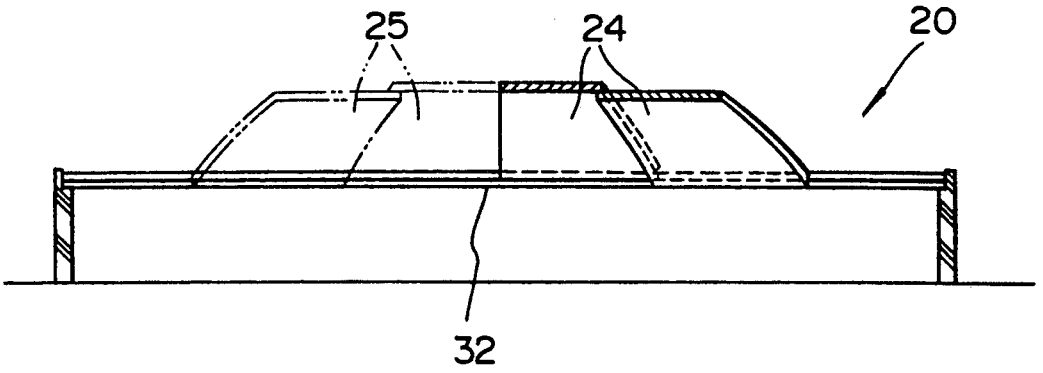
FIG. 7 is a side view of the openable roof in FIG. 6, showing a side indicated by arrow VII in FIG. 6.
Figure 8:
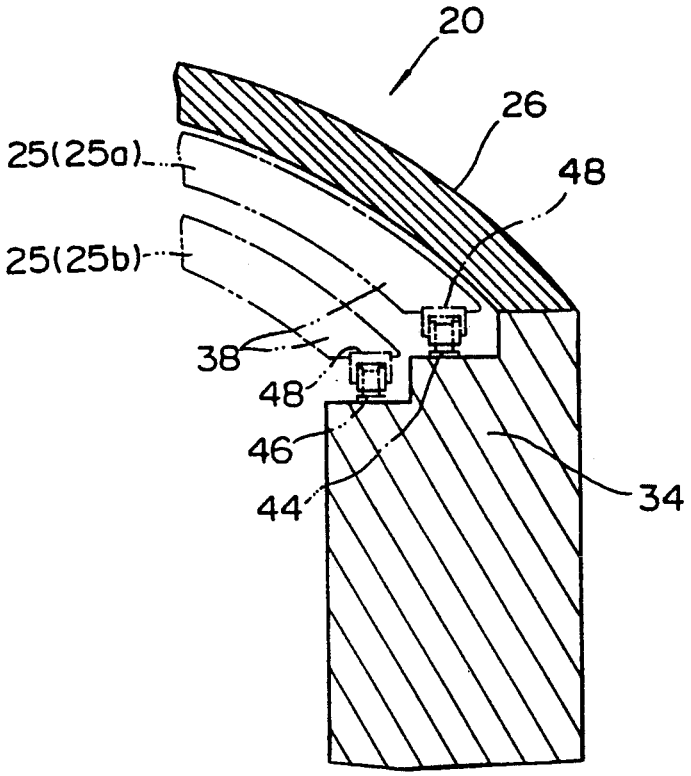
FIG. 8 is a side cross-sectional view of the support tracks for supporting the movable roof members of the openable roof in FIG. 6, and on which the movable roof members travel.

FIGS. 6–8 depict a second embodiment of the present invention. In the first embodiment, the tracks 40, 42, 44, and 46 are disposed in the same horizontal plane. In contrast, as best shown in FIG. 8, in the second embodiment, a step may be provided between the level of the track 44 and the level of the track 46. The movable roof members 24 and 25 are slidably disposed on the tracks 44 and 46 via the electrically driven wheels 48 in a manner similar to those in the first embodiment. Although FIG. 8 depicts only the tracks 44 and 46, the tracks 40 and 42 may be similarly formed.

Third Embodiment

Figure 9:
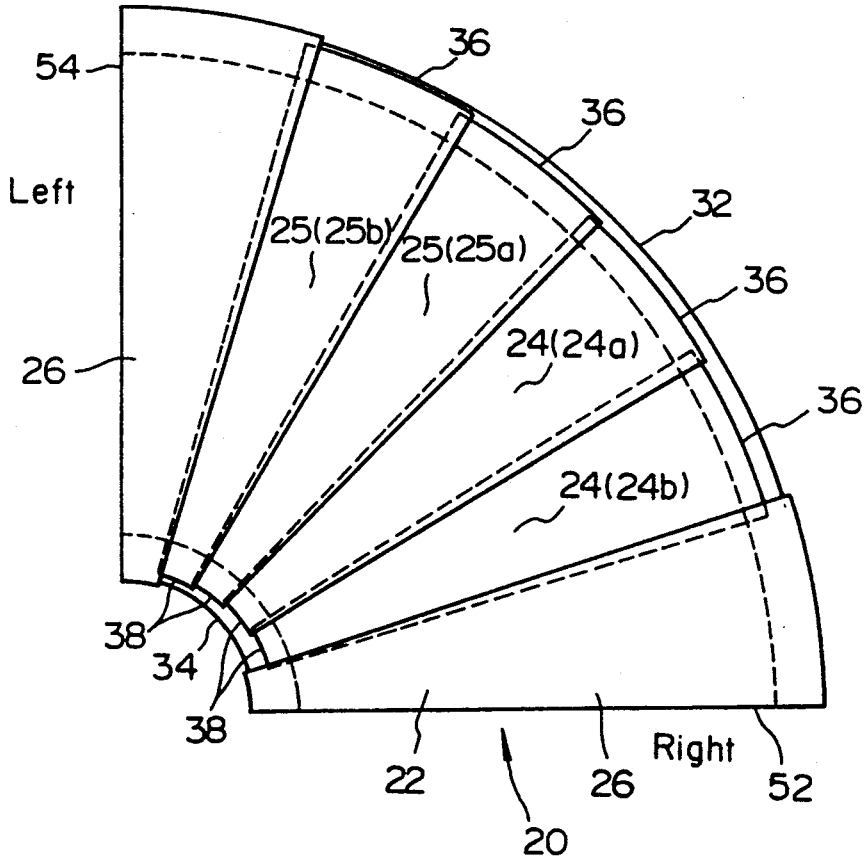
FIG. 9 is a plan view of an openable roof according to a third embodiment of the present invention.
Figure 10:
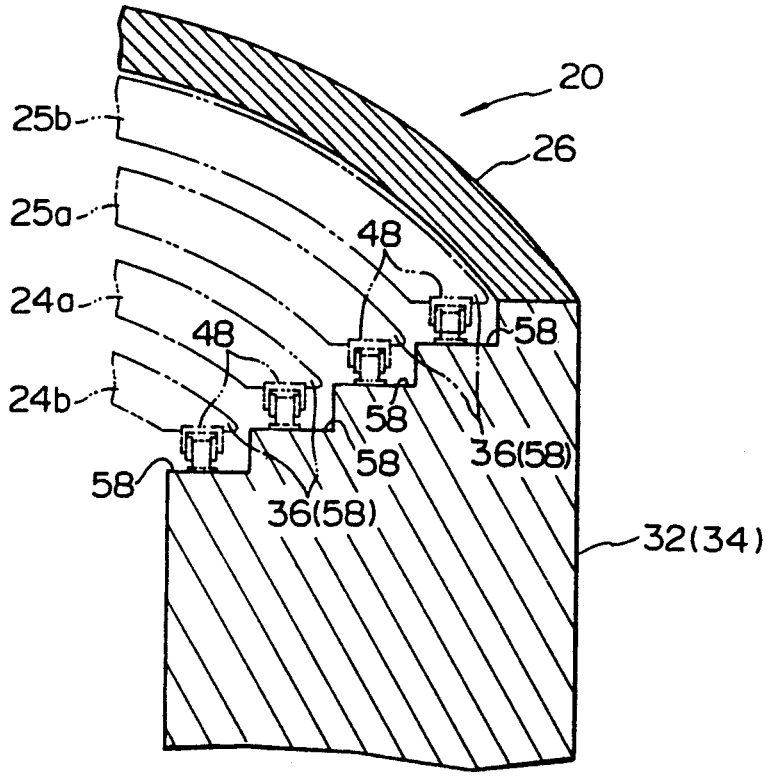
FIG. 10 is a side cross-sectional view of the support tracks for supporting the movable roof members of the openable roof in FIG. 9, and on which the movable roof members travel.

FIGS. 9 and 10 depict a third embodiment of the present invention. In the third embodiment, each of the arcuate supports 32 and 34 comprises four steps on the upper face thereof. On each of the steps, each of tracks 58 is installed along the arcuate shape of the corresponding supports 32 or 34. The movable roof members 24*a*, 24*b*, 25*a*, and 25*b* are slidably disposed on the tracks 58 via the electrically driven wheels 48 in a manner similar to those in the first embodiment.

In the third embodiment, when the roof 20 is open, all of the movable roof members 24*a*, 24*b*, 25*a*, and 25*b* can be stored under either of the fixed roof members 26 which are disposed on the outermost wings of the roof 20. Off course, the right wing and left wing movable roof members 24 and 25 may be stored under the fixed roof members 26 separately, in the same manner as in the first embodiment.

What is claimed is:

1. An openable roof for selectively covering a given area, and having a generally sectorial plan shape forming a central angel, the roof comprising:

an inner arcuate support member and an outer arcuate support member, said inner and outer arcuate support members being concentrically disposed relative to each other about a common axis;

a plurality of moveable roof members, each of the roof members having a generally sectorial plan shape forming a central angle smaller than the central angle of the openable roof, and including i) an outer edge portion supported on the outer arcuate support member for movement therealong, and ii) an inner edge portion supported on the inner arcuate support member for movement therealong, each of the movable roof members being supported by the inner and outer arcuate support members independent of the others of the movable roof members, wherein the moveable roof members are moveable over the inner and outer support members between a closed position, in which the roof members extend over and cover the given area, and an open position in which the moveable roof members form a sectorial shaped opening between the support members and over said given area; and first and second fixed roof members permanently mounted on the inner and outer arcuate support members in fixed positions relative thereto, and wherein the first and second fixed roof members are separated from each other, and each of the first and second fixed roof members has a sectorial plan shape and extends between the inner and outer arcuate support members on a respective radius of the sectorial plan shape of the openable roof.

2. An openable roof according to claim 1, wherein at least said one of the moveable roof members is supported on the inner and outer support members for movement into a position beneath said fixed roof member; and in the open position of the moveable roof members, said one of the moveable roof members is located beneath said fixed roof members.

3. An openable roof according to claim 2, wherein:

each of the moveable and fixed roof members has the shape of a section of a sphere; and when the moveable roof members are in their closed position, the roof has a dome shape.

4. An openable roof according to claim 1, wherein:

the roof has first and second lateral sides;

the first fixed roof member is located at the first lateral side of the roof; and the roof further comprises a second fixed roof member having a generally sectorial plan shape, and permanently mounted on the inner and outer arcuate support members in a fixed position relative thereto at the second lateral side of the roof.

5. An openable roof according to claim 4, wherein:

the first and second fixed roof members are spaced from each other; and in the closed position of the moveable roof members, the moveable roof members completely extend across the space between the first and second fixed roof members.

6. An openable roof according to claim 1, wherein:

the inner arcuate support member includes i) an arcuate base having a horizontal top surface, and ii) a first track disposed on said top horizontal surface;

the outer arcuate support member includes i) an arcuate base having a horizontal top surface, and ii) a second track disposed on the tope surface of the outer support member;

the outer edge portions of the moveable roof members are movably supported on the first track; and the inner edge portions of the moveable roof members are movably supported on the second track.

7. An openable roof according to claim 6, wherein the inner and outer arcuate support members are fixed on the ground.

8. An openable roof according to claim 1, further comprising drive means located under the outer and inner edge portions of the moveable roof members to drive the moveable roof members along the inner and outer arcuate support members.

9. An openable roof according to claim 1, wherein each of the inner and outer arcuate support members forms an arc, having said common axis as an apex, of between about 90° and 100°.

10. An openable roof according to claim 9, wherein the arc formed by each of the inner and outer arcuate support members is about 95°.

11. An openable roof according to claim 1, wherein the inner and outer arcuate support members are located at or immediately adjacent opposite ends of the given area.

12. An openable roof according to claim 1, wherein:

said openable roof is adapted to cover completely a structure bounding said given area;

the inner arcuate support member is disposed on a first end of the structure, at a first end of the given area; and the outer arcuate support member is disposed on a second end of the structure, opposite to the first end thereof, and at a second end of the given area, opposite to the first end thereof.

13. An openable roof for selectively covering a given area, and having a generally sectorial plan shape forming a central angle of approximately 90°-100° degrees, the roof comprising:

an inner arcuate support member and an outer arcuate support member, said inner and outer arcuate support members being concentrically disposed relative to each other about a common axis;

a plurality of moveable roof members, each of the roof members having a generally sectorial plan shape forming a central angle smaller than the central angle of the openable roof, and including i) an outer edge portion supported on the outer arcuate support member for movement therealong, and ii) an inner edge portion supported on the inner arcuate support member for movement therealong, each of the movable roof sections being supported by the inner and outer arcuate support members independent of the others of the movable roof members, wherein the moveable roof members are movable over the inner and outer support members between a closed position, in which the roof members extend over and cover the given area, and an open position in which the moveable roof members form a sectorial shaped opening between the support members and over said given area; and first and second fixed roof members permanently mounted on the inner and outer arcuate support members in fixed positions relative thereto, and wherein the first and second fixed roof members are separated from each other, and each of the first and second fixed roof members has a sectorial plan shape and extends between the inner and outer arcuate support members on a respective radius of the sectorial plan shape of the openable roof.

* * * * *

UNITED STATES PATENT AND TRADEMARK OFFICE

CERTIFICATE OF CORRECTION

PATENT NO. : 5,203,125
DATED : 4-20-93
INVENTOR(S) : Kenichi Sugizaki

It is certified that error appears in the above-indentified patent and that said Letters Patent is hereby corrected as shown below:

Column 2, line 47: before "DISCRIPTION" insert --BRIEF--

Column 2, line 53" "the is" should read --the roof is--

Signed and Sealed this

Eleventh Day of January, 1994

*Attest:*

*Attesting Officer*

BRUCE LEHMAN

*Commissioner of Patents and Trademarks*